US006056228A

United States Patent [19]

Resch

[11] Patent Number: 6,056,228

[45] Date of Patent: May 2, 2000

[54] TUBE MAGAZINE FOR A CHEESE PRODUCING TEXTILE MACHINE

[75] Inventor: Ludwig Resch, Töging, Germany

[73] Assignee: W. Schlafhorst AG & Co., Germany

[21] Appl. No.: 09/174,440

[22] Filed: Oct. 16, 1998

[30] Foreign Application Priority Data

Nov. 17, 1997 [DE] Germany ..... 197 50 859

[51] Int. Cl.[7] ..... B65H 54/26; B65H 67/04

[52] U.S. Cl. ..... 242/473.6

[58] Field of Search ..... 242/473.5, 473.6, 242/473.7, 473.8; 414/416, 281, 331, 910, 911; 57/281, 266, 267

[56] References Cited

U.S. PATENT DOCUMENTS

| | | | |
|---|---|---|---|
| 3,811,631 | 5/1974 | Mayer et al. | 242/473.6 |
| 4,571,931 | 2/1986 | Kupper | 57/281 |
| 4,724,666 | 2/1988 | Kupper | 57/281 X |
| 4,753,065 | 6/1988 | Mack et al. | 57/281 X |
| 4,830,561 | 5/1989 | Kraske | 414/281 X |
| 4,858,746 | 8/1989 | Ito et al. . | |
| 4,970,856 | 11/1990 | Taniguchi et al. | 57/281 |
| 5,040,660 | 8/1991 | Ohta et al. . | |
| 5,119,621 | 6/1992 | Inger | 57/281 |
| 5,299,750 | 4/1994 | Nakagawa et al. | 242/473.6 |
| 5,350,128 | 9/1994 | Deters et al. | 242/473.6 |
| 5,402,355 | 3/1995 | Bahlmann et al. | 242/473.6 X |
| 5,582,354 | 12/1996 | Peters | 242/473.6 |
| 5,588,603 | 12/1996 | Nakaji | 242/473.6 |
| 5,937,629 | 8/1999 | Spindler et al. | 242/473.4 X |

FOREIGN PATENT DOCUMENTS

| | | |
|---|---|---|
| 0 262 726 A2 | 9/1987 | European Pat. Off. . |
| 0 393 780 A1 | 4/1990 | European Pat. Off. . |
| 34 41 778 A1 | 5/1986 | Germany . |
| 39 08 462 A1 | 2/1990 | Germany . |
| 38 29 990 A1 | 3/1990 | Germany . |
| 42 17 575 A1 | 12/1992 | Germany . |
| 43 41 926 A1 | 6/1995 | Germany . |
| 43 41 946 A1 | 6/1995 | Germany . |
| 44 40 015 A1 | 6/1995 | Germany . |
| 195 29 566 A1 | 2/1996 | Germany . |

*Primary Examiner*—Donald P. Walsh
*Assistant Examiner*—Collin A. Webb
*Attorney, Agent, or Firm*—Kennedy Covington Lobdell & Hickman

[57] ABSTRACT

A central magazine (11) of a tube feeding device of a textile machine, for example an automatic cheese winder (1), has a central unit (50) with an integrated tube transfer device and an exchangeable tube storage unit (51) fixed in place on the central unit (50). The tube transfer device comprises a vertically displaceable gripper support (16) with at least one positively controllable tube gripper (17). The storage unit (51) has several storage columns (12 to 15) arranged next to each other, each having a number of feed shafts (22) arranged atop each other. The tube grippers (17) on the gripper support (16) take the tubes (8) from the feed shafts (22) and transfer them to a tube transport carriage (20) of a tube conveying device (10) extending over the length of the machine, which carriage can be displaced between a position above the respective storage columns (12 to 15) of the central magazine (11) and interim reservoirs (9) which are a part of the winding stations.

20 Claims, 6 Drawing Sheets

TUBE MAGAZINE FOR A CHEESE PRODUCING TEXTILE MACHINE

FIELD OF THE INVENTION

The present invention relates to a centralized magazine for storing empty yarn winding tubes for a tube-feeding device of a textile machine for producing packages of wound yarn commonly known as cheeses. More particularly, the present invention relates to a tube magazine for cheese-producing textile machines having a storage device for receiving a plurality of tubes and a tube transfer device for transferring the tubes to a conveying device extending over the length of the machine.

BACKGROUND OF THE INVENTION

Various tube magazines are known in connection with textile machines for producing cheeses or in connection with their tube-feeding devices. In most cases, the tube magazines are arranged at the end of the machine.

For example, a pneumatic false twist machine is described in German Patent Publication DE 39 08 462 A1, which is serviced by two cheese changers patrolling in front of the winding stations of the spinning machine. Here, each one of the two cheese changing units has its own tube reservoir in which a large amount of empty tubes is stored. In addition and as known, the cheese changers are equipped with manipulating devices, which are adapted both for removal of full cheeses from the winding devices and for the transfer of empty tubes from the tube reservoir of the changer to the winding devices of the individual winding stations. A tube magazine with a tube transfer device is assigned to each one of the two cheese changers in the area of the machine ends of the false twist machine. Each of the tube magazines has several shafts, in which empty tubes are arranged and aligned in the way they are needed by the tube reservoirs of the cheese changers. A tube transfer device in the form of a conveyor belt is mounted underneath the empty tube receiving shafts. The conveyor belt is guided around a drive roller and a reversing roller; with its direction of conveyance extending transversely with respect to the longitudinal direction of the machine. The conveyor belts of the tube magazines convey the empty tubes, without changing their alignment, via a drop shaft directly into the tube reservoir of the respective cheese changer.

German Patent Publication DE 42 17 575 A1 describes a winding machine which is provided with empty tubes via a central magazine arranged at the end of the machine.

A plurality of conical empty tubes are stored in a vertical alignment in this central magazine. The conical tubes are stacked inside each other in a manner such that the respectively lowest tube can be pulled off by means of a special device and transferred over a slide to a tube transfer device. The tube transfer device is designed as an elevator, which transfers the tubes to a tube conveyor belt extending over the length of the machine. Thereafter, by way of the tube conveyor belt the tubes are delivered to the area of a movable service unit, which supplies the winding stations of the textile machine. The service unit, preferably a cheese changer, is equipped with, among other things, an interim tube reservoir, a tube receiving device and a tube transfer device.

European Patent Publication EP 0 262 726 A2 describes a textile machine for producing cheeses, having at least one central magazine arranged at an end of the machine. Here, the central magazine has circulating storage chains with mandrels for receiving empty tubes. When required, a tube transfer device integrated into the central magazine pushes the required tubes off the receiving mandrels onto a slide for transfer onto a tube conveyor belt extending over the length of the machine, which conveys the tubes to a movably arranged cheese changer. The cheese changer removes the required tube from the conveyor belt and transfers it directly into the spinning frame of the respective spinning station.

SUMMARY OF THE INVENTION

In view of the above mentioned arrangements for feeding empty yarn winding tubes in cheese producing textile machines, it is an object of the present invention to improve the known tube feeding devices of cheese producing textile machines and, in particular, their central magazines.

Briefly summarized, the present invention provides a central magazine for a tube-feeding device of a textile machine for winding yarn onto tubes to produce cheeses, wherein the tube-feeding device has a tube conveying device extending over the length of the machine. In accordance with the present invention, the foregoing object is achieved by providing the central magazine with a central unit and a storage unit releasably fastened on the central unit for receiving a plurality of empty yarn winding tubes. The central unit has a tube transfer device for transferring the empty tubes form the storage unit to the tube conveying device, the tube transfer device preferably comprising a vertically displaceable gripper support with at least one positively controllable tube gripper. Preferably, the storage unit has several storage columns arranged next to each other, each of which has several feed shafts arranged on top of each other. The feed shafts, which are inclined in the direction toward the gripper support, each contain approximately 10 to 12 cylindrical or conical empty tubes.

Such controllable tube grippers arranged on vertically movable gripper supports constitute an uncomplicated and dependable connecting element between the storage columns of the storage unit and the tube conveying carriage of the tube conveying device extending over the length of the machine, which operates dependably at all times, even under the difficult environmental conditions usually found in spinning mills.

In a preferred embodiment, the gripper support has several tube grippers, which are arranged next to each other and can be positively controlled. The number of tube grippers preferably corresponds to the number of storage columns of the storage unit. Thus, only a vertical positioning of the gripper support and the control of the respective gripper support is necessary for taking over a tube stored in the feed shafts of the storage columns. Thereafter, the taken-up tube can be moved into a position in which it can be taken over without problems by a gripping device arranged on the tube transport carriage of the tube conveying device by displacing the gripper support into an upper transfer position.

As indicated, the central magazine has a storage unit which is fixed, preferably in an easily exchangeable manner, on the central unit. Such an embodiment makes it possible, for example, for the storage unit to be first completely emptied and thereafter to be exchanged for a fresh, filled storage unit. In such case, the fresh storage unit is equipped with fresh, empty tubes in a tube loading station, which can also be located in a remote department. Thus, because of the possibility of quickly exchanging an emptied storage unit without problems for a filled storage unit, it is no longer necessary for the operators to monitor the fill status of the storage unit at short intervals and to continuously refill them with fresh empty tubes.

By means of the arrangement of the storage columns, which are preferably clearly marked by different colors, the central magazine in accordance with the invention is also well suited for textile machines operating in a multi-batch manner. Any risk that the storage columns of the storage unit may be mistakenly loaded with the wrong empty tubes by the operators is additionally minimized by providing a storage device above each storage column into which a sample of the tube needed in the respective storage column may be placed in a clearly visible manner.

As indicated, each storage column is preferably assigned its own tube gripper arranged on vertically movable gripper supports. The tube grippers are displaced together in respect to their operating level, but can be positively controlled individually by means of a programmable control device which is a part of the central magazine.

By means of employing several like, comparatively simply constructed tube grippers, the control outlay and therefore the expense for the tube transfer device integrated into the central unit is kept relatively low, but the sturdy tube grippers are also distinguished by their easy availability and a long service life. Thus, the tube grippers have been optimally adapted to the known difficult environmental conditions in spinning mills.

Preferably, sensor devices, such as light scanners, are arranged on the gripper support to monitor the fill status of the feed shafts. The sensor devices are connected by means of signal lines with the control device of the central magazine. The sensor devices assure that the gripper support does not position the tube grippers in front of an empty feed shaft. Thus, when a sensor device detects that the feed shaft which was approached no longer contains empty tubes, the gripper support is displaced by one row of feed shafts, for example downward, so that the respective tube gripper again is in front of a filled feed shaft.

Advantageously, the control device of the central magazine can be programmed by means of an input keyboard. Thus, it is possible via the input keyboard to preset defined parameters, for example in respect to the sequence of the emptying of the storage columns and/or their feed shafts, as well as the progression and amount of the supply of the interim reservoirs, which are part of the winding stations, all of which is positive, in particular in connection with a batch change, since it is possible in this way to minimize the down time of the textile machine.

As already indicated, the sensor devices arranged on the gripper support are connected with the control device of the central magazine. A reversible drive is additionally connected with this control device, which provides for the vertical displacement of the gripper support by means of an endless toothed belt. Advantageously, an incremental transducer, which is also connected with the control devices of the central magazine, is provided in the area of one of the drive pinions of the endless toothed belts to provide for the exact vertical positioning of the gripper support, for example in relation to the feed shafts.

The feed shafts preferably have respective lateral guide strips, which assure the optimal rolling off of the tubes inside the feed shafts, which preferably are arranged in an inclined manner. The alignment of the tubes inside the feed shafts is such that the center axes of the tubes extend approximately orthogonally in respect to the center longitudinal axes of the feed shafts. In order to assure this alignment also in connection with non-cylindrical, e.g. conical, tubes, it is provided further that each guide strip against which the conical tubes rest with their smaller diameter is seated in a longitudinally movable manner.

Preferably, the tube grippers additionally have a control lever which acts on the movable strip in the longitudinal direction each time tubes are received. Thus, with each tube reception process an alignment of the tubes is performed by means of a controlled movement of the strip opposite the rolling direction of the tubes, and in this way any incipient canting of the tubes is immediately and actively counteracted. A control cam on the control lever prevents the tubes in the feed shaft from also being acted upon when the longitudinally movable strip returns into its initial position under the force of a spring. In the interest of a trouble-free progression of the tube transfer, the frictional values of both the fixed lateral tube guides and the movable strip have also been optimized.

Further aspects, features, details and advantages of the invention will be understood from a description of an exemplary embodiment set forth below with reference to the accompanying drawings.

DESCRIPTION OF THE PREFERRED EMBODIMENT

Figure 1:
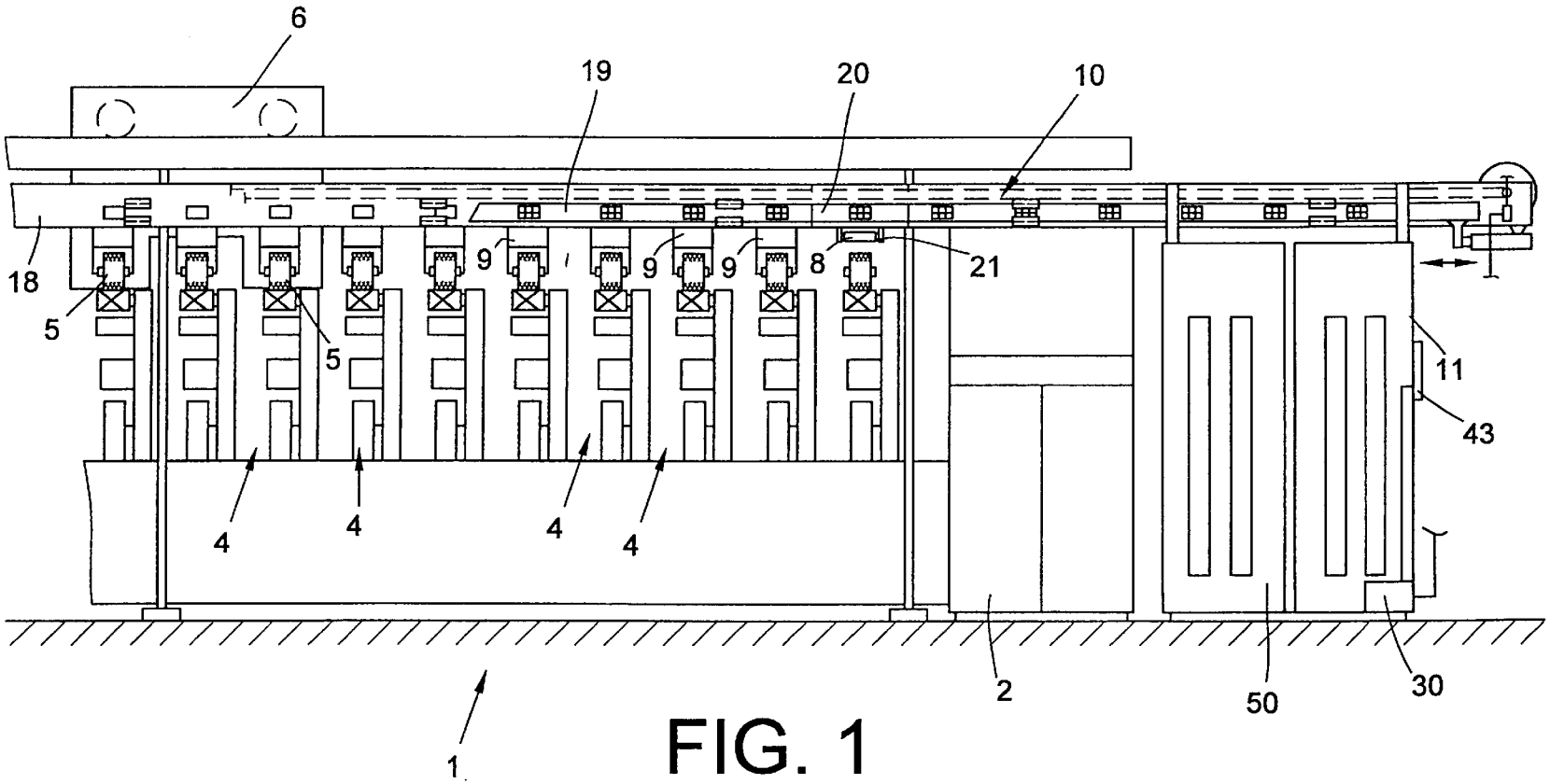
FIG. 1 is a front view of an automatic winding machine with a tube feeding device having a central magazine in accordance with the present invention.
Figure 2:
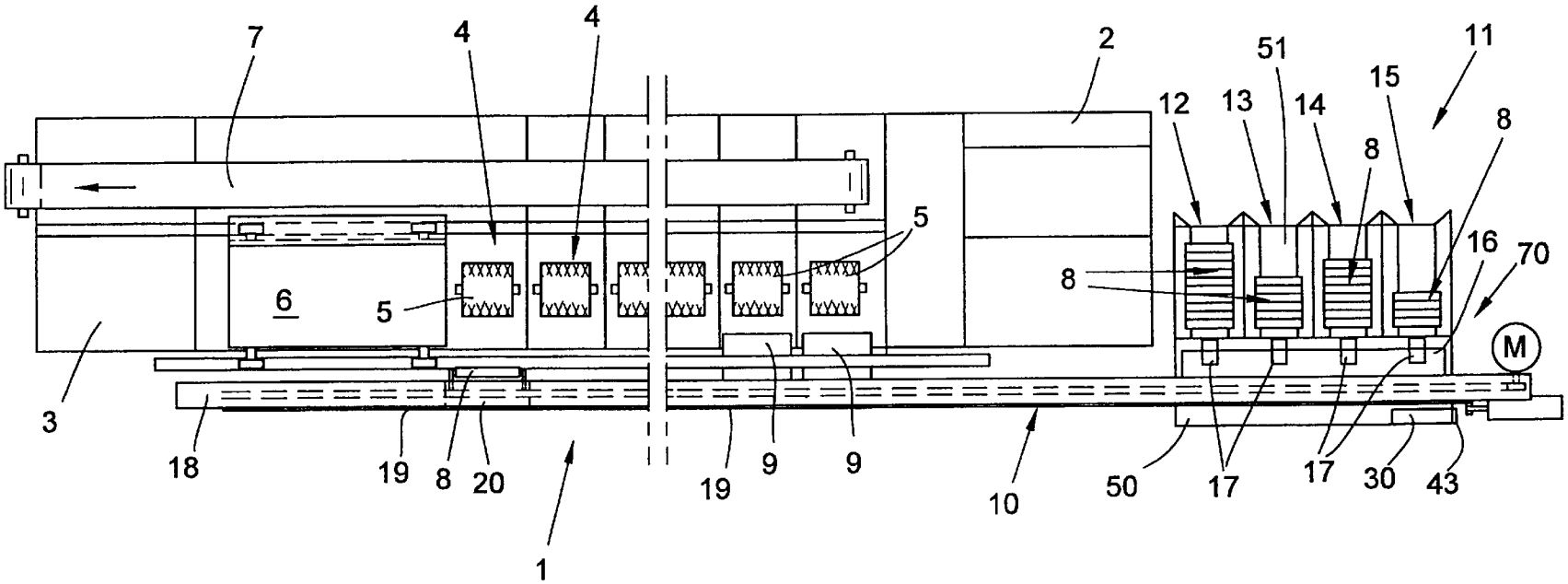
FIG. 2 is a top plan view of the automatic winding machine and the associated tube feeding device of FIG. 1.

Referring now to the accompanying drawings and initially to FIGS. 1 and 2, an automatic cheese winding machine 1 is shown schematically and basically has a plurality of yarn winding stations 4 extending in alignment with one another between end frames 2 and 3 at opposite ends of the machine. As is known and therefore not explained in greater detail, yarn from spinning cops produced on a ring spinning machine (not represented) are rewound at these winding stations 4 onto winding tubes to form yarn packages 5 of larger volume commonly referred to as cheeses or bobbins. The finished cheeses 5 are subsequently transferred onto a cheese conveyor belt 7 by means of an automatically operating service device, for example by means of a cheese changer 6, and are transported to a bobbin loading device (not represented) or the like, which is arranged at one end of the machine.

The cheese changer 6 is movably arranged above the winding stations 4 and is operative to push the cheeses 5 when finished at the winding stations 4 laterally onto the cheese conveyor belt 7 and also to automatically transfer an empty winding tube 8 into the winding frame of the respective winding station 4. In the embodiment shown, the cheese changer 6 takes the respective tube 8 out of an interim reservoir 9, which is part of each winding station and is connected via a tube conveying device 10 extending over the length of the machine to a central magazine 11 of the automatic cheese winder 1 arranged at one end of the machine.

The central magazine is identified as a whole by 11 as represented in FIGS. 1 to 4 and essentially consists of two main components. A first main component is in the form of a central unit 50 having a programmable control device 30, which can be programmed by means of an input keyboard 43, and having a tube transfer device 70 in the form of a vertically displaceable gripper support 16 having tube grippers 17. A second main component is constituted by a storage unit 51, which is affixed on the central unit 50 in an easily exchangeable manner. The storage unit 51 has several storage columns 12, 13, 14, 15 arranged next to each other and each having a number of feed shafts 22, arranged vertically one atop another, for receiving conical and/or cylindrical empty tubes 8.

The central magazine 11 is functionally connected with a tube conveying device extending over the length of the machine by means of the vertically displaceable gripper support 16 which, as will be explained in more detail below, respectively has a positively controllable tube gripper 17 in the area of the storage columns 12 to 15.

The tube conveying device 10 essentially consists of a horizontal track 18 having a plurality of windows formed along the length thereof, a window control strip 19 also having a like plurality of windows spaced along its length, and a tube transport carriage 20 arranged on the horizontal track 18 and movable between the central magazine 11 and the interim reservoirs of the winding stations. A tube gripper device 21 arranged on the tube transport carriage 20 is adapted to be magnetically activated by displacing the window control strip 19.

Figure 3:
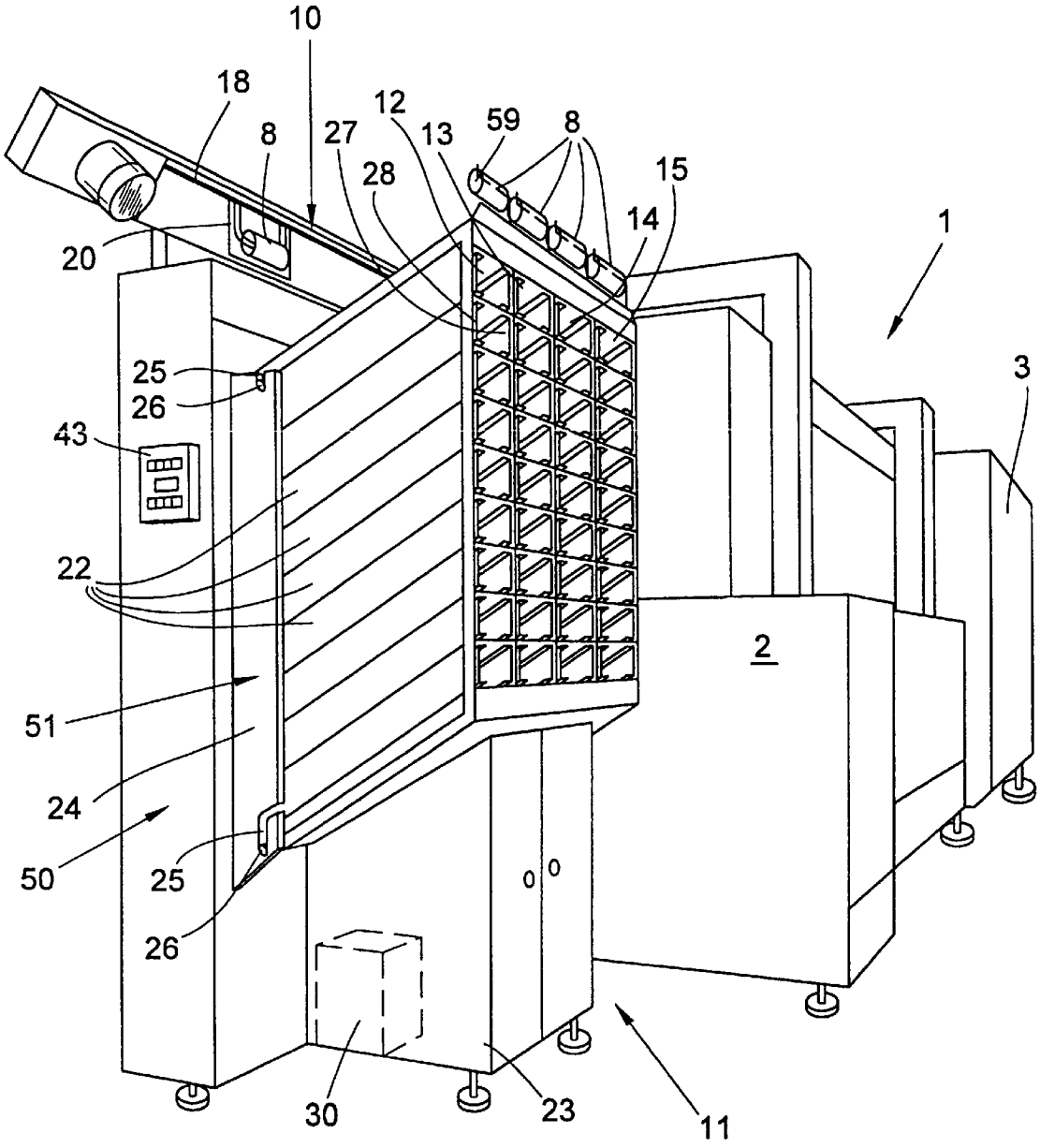
FIG. 3 is a back perspective view of the central magazine of the tube feeding device of the present invention.

FIG. 3 shows in a perspective representation a back view of the automatic cheese winder 1 at the rightward end (as viewed in FIGS. 1 and 2) at which the central magazine 11 of the present invention is arranged adjacent the end frame 2 of the automatic cheese winder 1. As already mentioned above, the central magazine 11 consists of a central unit 50 and a storage unit 51.

A control cabinet 23 is attached to the central unit 50 which, among other things, receives the control device 30 of the central magazine as well as electric and pneumatic connections (not represented) of the central magazine 11. In addition, specialized fastening brackets 24 formed with connecting slots 25 are arranged on the rear of the central unit 50, by means of which the storage unit 51 can be affixed thereon in an easily exchangeable manner via lateral seating bolts 26 which are received in the slots 25.

The arrangement of the four storage columns 12 to 15 adjacent each other on the storage unit 51 with each having several feed shafts 22 arranged on top of each other can furthermore be seen from the exemplary embodiment in FIG. 3. Each of the feed shafts 22 is inclined downwardly in the direction toward the central unit 50. Depending on their length, each feed shaft 22 can receive and store approximately 10 to 12 of the empty tubes 8 with the tubes 10 being guided at their ends by guide strips 27, 28 within the shafts 22.

As indicated in FIG. 3, storage devices 59 are provided above the storage columns 12 to 15, each of which receives a sample of the proper type of empty tube 8 to be stored in the respective storage column, thereby to prevent loading of improper tubes.

Figure 4:
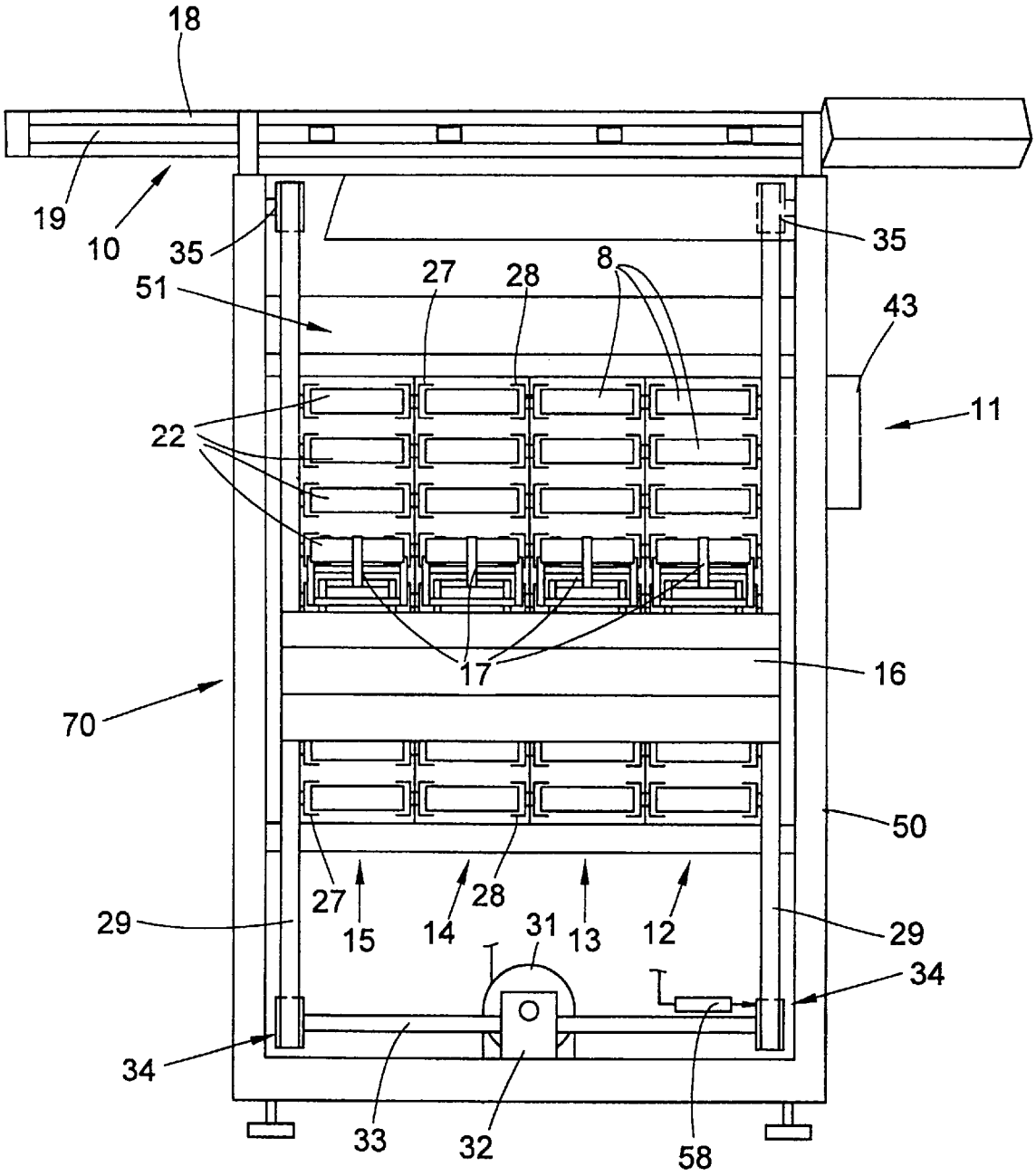
FIG. 4 is a front elevational view of the central magazine, wherein the covering of the central unit has been removed.

As can be particularly seen in the opposite front view of the magazine 11 in FIG. 4, the central unit 50 has a vertically displaceable gripper support 16 with four tube grippers 17 mounted next to each other at the same spacing as the divisions of the storage columns 12 to 15.

In the embodiment represented, the gripper support 16 is fixed in place on two laterally arranged endless toothed belts 29, which are acted upon by a common drive 31, preferably an electric drive motor. The electric drive 31 acts via an angular gear 32 to drive a continuous driveshaft 33 having drive pinions 34 at its respective ends for the synchronous driving of the endless toothed belts 29. In addition, the endless belts 29 are trained over toothed reversing wheels 35. A sensor device 58, for example an incremental transducer, is preferably arranged in the area of one of the drive pinions 34 and is connected to the control device 30 of the central magazine to allow the exact positioning of the gripper support 16 and thus of the tube grippers 17 in front of the feed shafts 22 of the storage columns 12 to 15.

In an alternate embodiment (not represented), the gripper support 16 can also be guided in laterally spaced vertical guide devices with the displacement of the gripper support 16 being accomplished by means of a single centrally arranged endless toothed belt.

Figure 6:
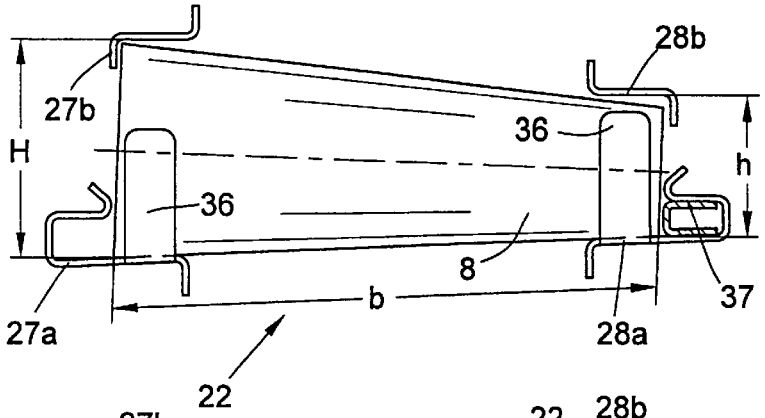
FIG. 6 is a cross sectional view taken along line VI—VI of FIG. 5 showing the guide strips of the feed shaft thereof.
Figure 5:
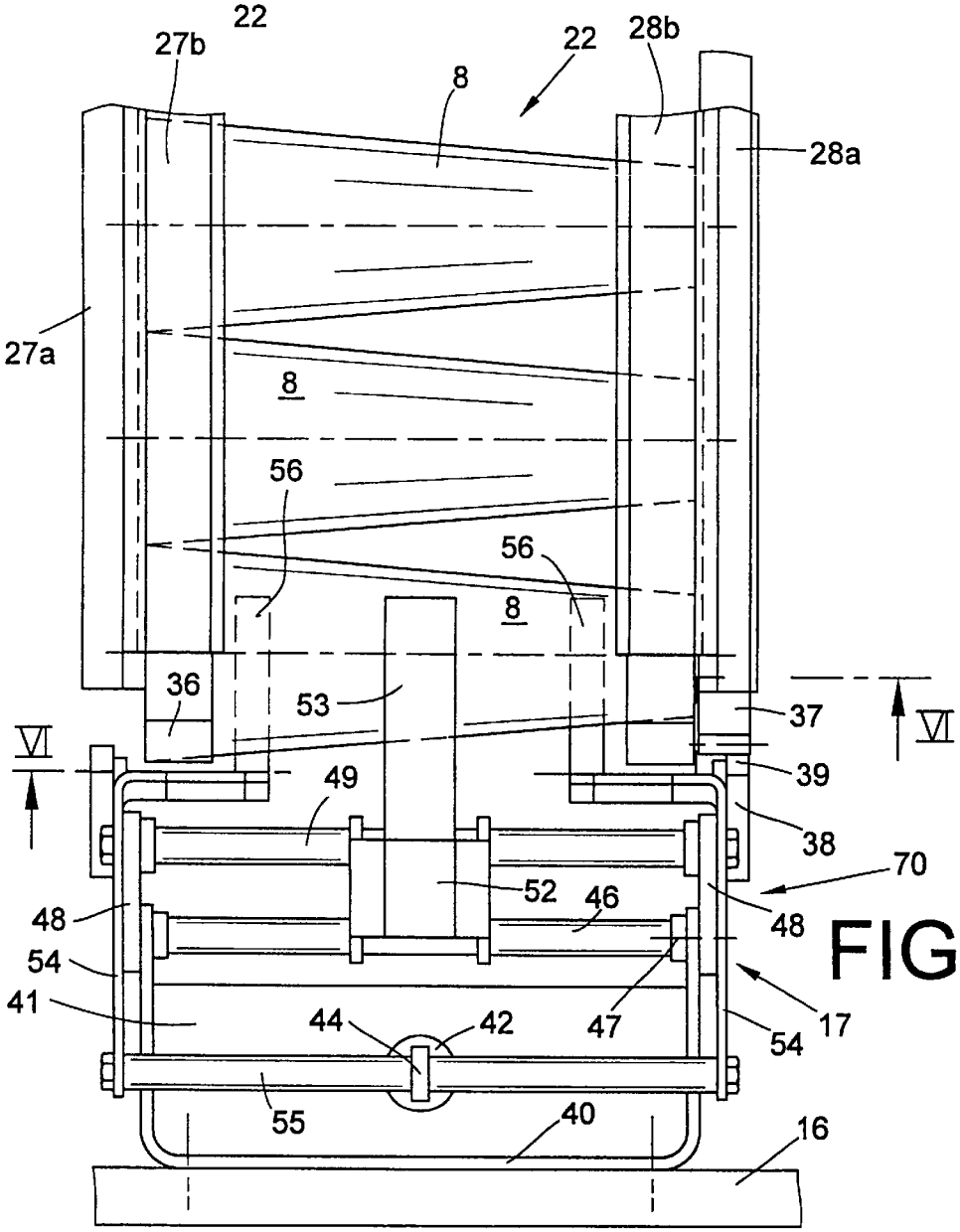
FIG. 5 is a top view of one of the tube grippers arranged on the gripper support of the central magazine, shown in the course of picking up an empty tube from one of the feed shafts of the central magazine.
Figure 7:
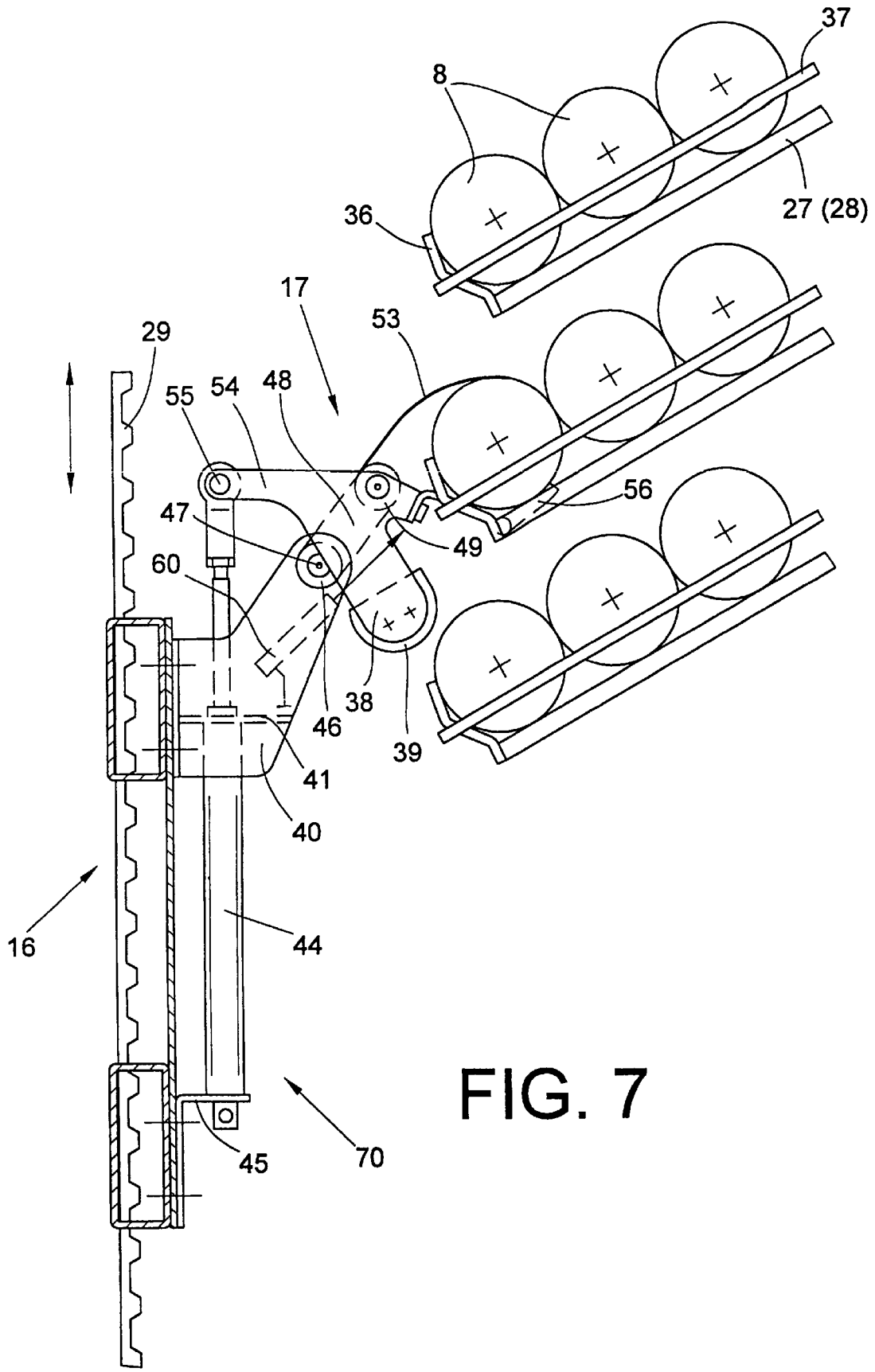
FIG. 7 is a side view of the tube gripper of FIG. 5.

As represented in FIGS. 5 to 7, the tubes 8 are stored in rows inside the feed shafts 22 under the constraint of lateral guide strips 27*a*, 27*b*, 28*a* and 28*b*. The vertical distance H, or respectively h, as well as the transverse distance b, between the guide strips 27*a* and 27*b* and between the guide strips 28*a* and 28*b* is matched to the shape and the size of the tubes 8 to be stored. The lower guide strips 27*a* and 28*a* in addition have a front stop 36, which prevents the tubes from rolling out of the feed shafts 22 at the front side of the magazine.

To prevent the occurrence of canting and blockage of the tubes 8 in the feed shafts 22 when conical tubes are stored, additional strips 37 are arranged to be movable in the longitudinal direction within the area of the lateral guides for the tube ends of smaller diameter (i.e. in the area of the guide strips 28*a* in the present exemplary embodiment). These movable strips 37 are acted upon during each tube removal operation by a control cam 39 arranged on a control lever 38 of the tube grippers 17 to perform an alignment of the tubes by moving the strip 37 opposite the direction in which the tubes roll within the feed shafts such that a threatened canting of the tubes in the feed shafts 22 is actively counteracted.

In addition, the control cams 39 also prevent the tubes 8 located in the feed shaft 22 from being acted upon by the return of the longitudinally movable strip 37 into its initial position under a spring force.

As can be seen from FIGS. 5 and 7, the tube grippers 17 are each fixed in place on the gripper support 16 by means of a bearing body in the form of a connecting bracket 40. Preferably, the connecting bracket 40 is reinforced by a sheet metal panel 41 having a bore 42 for a pneumatic cylinder 44. The pneumatic cylinder 44 is furthermore supported on a bracket 45 which is also fixed in place on the gripper support 16.

Shackle elements 48 are seated for limited movability around a pivot shaft 47 on the connecting bracket 40 and are connected with each other via cylindrical connecting elements 46, 49. In addition, a support 52 is inserted between the connecting element 46, 49, on which the upper gripper finger 53 of the tube gripper 17 can be fixed in place. The gripper finger 53 is preferably made of spring steel or the like.

The shackle elements 48 are connected with angled support plates 54 in the area of the connecting element 49.

The support plates 54 are connected with each other by the connecting element 55 and have the respective lower gripper fingers 56 of the tube gripper 17 on their angled end located opposite the connecting element 55.

The pneumatic cylinder 44 acts via its piston rod on the connecting element 55 thereby to actuate the associated tube gripper 17. As indicated in FIG. 7, a sensor device 60 is additionally installed in the area of each tube gripper 17. The sensor device 60, preferably a light scanner, is directed onto the foremost tube 8 in the feed shafts 22 and is connected to the control device 30 of the central magazine.

The functioning of the device may thus be understood. With the automatic cheese winder 1 ready for operation and the storage unit 51 of the central magazine 11 filled, the control device 30, which is also connected with the central control unit (not represented) of the automatic cheese winder 1, is programmed via the input keyboard 43 in accordance with the respective requirements for a desired operational process.

Triggered by a signal from the central control unit of the automatic cheese winder 1, the vertically movable gripper support 16 is directed to move to a location along the storage unit 51, for example the level of the lower feed shafts 22 of the storage unit 51. The tube transport carriage 20 is simultaneously positioned above the selected storage columns 12 to 15.

The respective tube gripper 17 takes the foremost tube 8 out of the associated feed shaft 22 and conveys it upward into a transfer position by means of a vertical displacement of the gripper support 16. In such transfer position, the tube transport carriage 20 of the tube conveying device 10 extending over the length of the machine takes the picked-up tube 8 with its gripper device 21 and conveys it over the horizontal track 18 to the interim reservoir 9 of a predetermined winding station 4.

Following the transfer of the tube 8 to the interim reservoir 9 of the respective winding station 4, the tube transport carriage 20 immediately returns to its initial position in the area of the central magazine 11 and awaits in readiness thereat for the next tube transfer by a tube gripper 17 arranged on the gripper support 16.

The above described tube feeding device is positively distinguished, among other things, by a reduction of the total of moving parts of the tube conveying device to a relatively few sturdy components, particularly in the area of the central magazine 11. Since all such components are designed for insensitivity to the large amounts of dust and dirt caused by the operation in spinning mills, it is assured that the device in accordance with the invention functions optimally, even under these known more difficult environmental conditions.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An apparatus for supplying empty yarn tubes to work stations of a textile winding machine for the production of cheeses, comprising:

(a) a tube conveyor extending adjacent each work station for the delivery of tubes thereto; and (b) a central magazine disposed adjacent said tube conveyor at a fixed location relative to the work stations, said central magazine including, (i) a storage unit defining a plurality of generally horizontally inclined feed shafts vertically arranged to define a storage column, each said feed shaft retaining a plurality of tubes for individual presentation of each tube at an end of said feed shaft, and (ii) a central unit including a gripper support disposed adjacent said storage unit and vertically movable between said ends of said feed shafts for the transfer of anyone of the tubes presented at said end of each said feed shaft to said tube conveyor.

2. The apparatus of claim 1, wherein said central unit comprises a programmable control device.

3. The apparatus of claim 1, wherein said gripper support comprises a plurality of positively controllable tube grippers arranged adjacent to each other.

4. The apparatus of claim 1, wherein said storage unit comprises a plurality of tube storage columns arranged adjacent to each other.

5. The apparatus of claim 4, wherein each said tube storage column of said storage unit has a plurality of horizontally inclined tube feed shafts arranged on top of each other.

6. The central magazine in accordance with claim 5, characterized in that the individual storage columns of the storage unit are distinguished by different coloration.

7. The central magazine in accordance with claim 5, characterized in that a storage device for storing a tube sample is arranged above the individual storage columns.

8. The apparatus of claim 4, wherein said gripper support includes a plurality of tube grippers each associated with a respective said tube storage column.

9. The apparatus of claim 4, further comprising a plurality of sensor devices arranged on said gripper support and wherein said sensor devices are arranged at a spacing corresponding to arrangement of said tube storage columns.

10. The apparatus of claim 8, wherein said central unit comprises a reversible drive for the vertical displacement of said gripper support and a programmable control device connected with said sensor devices arranged on said gripper support and connected with said reversible drive.

11. The apparatus of claim 11, wherein said reversible drive comprises a reversible electric motor and at least one endless toothed belt connecting said gripper support with said motor.

12. The apparatus of claim 1, further comprising a plurality of sensor devices arranged on said gripper support.

13. The apparatus of claim 12, wherein said sensor devices comprise light scanners.

14. The apparatus of claim 1, wherein said central unit comprises an input keyboard.

15. The apparatus of claim 1, wherein said storage unit is releasably fastened to said central unit.

16. The apparatus of claim 1, wherein a said feed shaft includes lateral guide strips for guiding the tubes retained therein during rolling.

17. The apparatus of claim 16, wherein at least one said lateral guide strip is longitudinally movable for support of an end of a conical tube during rolling.

18. A central magazine for a tube-feeding device of a textile machine for winding yarn onto tubes to produce cheeses, wherein the tube-feeding device has a tube conveying device extending over the length of the machine, the central magazine comprising:

a central unit; and a storage unit releasably fastened on the central unit for receiving a plurality of empty yarn winding tubes;

wherein, the central unit has a tube transfer device for transferring the empty tubes from the storage unit to the tube conveying device, the tube transfer device comprising a vertically displaceable gripper support with at least one positively controllable tube gripper, the storage unit comprises a plurality of tube storage columns arranged adjacent to each other with each tube storage column having a plurality of tube feed shafts arranged on top of each other, and the gripper support has sensor devices arranged thereon at a spacing corresponding to arrangement of the storage columns.

19. A central magazine for a tube-feeding device of a textile machine for winding yarn onto tubes to produce cheeses, wherein the tube-feeding device has a tube conveying device extending over the length of the machine, the central magazine comprising:

a central unit; and a storage unit releasably fastened on the central unit for receiving a plurality of empty yarn winding tubes;

wherein the central unit has a tube transfer device for transferring the empty tubes from the storage unit to the tube conveying device, the tube transfer device comprising a vertically displaceable gripper support with a plurality of positively controllable tube grippers, the storage unit comprises a plurality of tube storage columns arranged adjacent to each other with each tube storage column being associated with a respective tube gripper, and at least one tube feed shaft has lateral guide strips for the guidance of empty tubes stored therein.

20. The central magazine of claim 19, characterized in that at least one guide strip is longitudinally movable for association with a smaller diameter of non-cylindrical empty tubes.

* * * * *